United States Patent [19]

Stockman

[11] 4,185,687

[45] Jan. 29, 1980

[54] COOLING TOWER

[75] Inventor: Richard F. Stockman, Friendship, N.Y.

[73] Assignee: The Air Preheater Company, Inc., Wellsville, N.Y.

[21] Appl. No.: 879,821

[22] Filed: Feb. 21, 1978

[51] Int. Cl.[2] ..... F28D 19/00

[52] U.S. Cl. ..... 165/8; 165/DIG. 1; 165/10; 261/92; 403/167

[58] Field of Search ..... 165/6, 8, 10, DIG. 1; 261/92; 403/167, 168; 415/90

[56] References Cited

U.S. PATENT DOCUMENTS

| | | | |
|---|---|---|---|
| 1,948,277 | 2/1934 | Payne et al. | 261/92 |
| 1,961,508 | 6/1934 | Persons | 261/92 |
| 1,976,228 | 10/1934 | Hutzel | 261/92 |
| 2,060,636 | 11/1936 | Persons | 261/92 X |
| 2,394,686 | 2/1946 | Hammond | 403/168 |
| 2,535,351 | 12/1950 | Crawford | 165/7 X |
| 3,804,155 | 4/1974 | Glicksman | 165/6 X |

*Primary Examiner*—Albert W. Davis, Jr.
*Attorney, Agent, or Firm*—Wayne H. Lang

[57] ABSTRACT

A rotor for a gas-liquid heat exchange device that comprises a plurality of spaced heat absorbent elements mounted on a rotary shaft. The shaft is adapted to be rotated continuously between a hot liquid and a cool gas in order that heat contained in the hot liquid is first absorbed by the elements and then, as the elements rotate, the heat of the elements is transferred to the cooler gas for dissipation into the surrounding air.

7 Claims, 4 Drawing Figures

COOLING TOWER

BACKGROUND OF THE INVENTION

Power generation, manufacturing, air conditioning and various industrial processes require significant amounts of thermal dissipation in order that continuous operation may be effected. Recent ordinances forbid the discharge of excessive heat into public waterways so large water-cooled heat exchangers are not permitted, or are at least looked upon with much disfavor. Furthermore, common evaporative heat exchangers consume excessive amounts of water and they in turn precipitate excessive amounts of moisture into the air causing extensive ground fog or vapor over neighboring areas, so they too are generally classified as undesirable.

An alternative to evaporative heat exchangers comprises an arrangement known as "dry" cooling towers. In "dry" cooling towers heat is discharged therefrom directly into the air without the evaporation of water whereby such heat exchangers have a low effectiveness and they are relatively expensive to operate. However, inasmuch as they do not discharge heat into adjacent bodies of water nor do they discharge moisture into the atmosphere, they have obvious environmental advantages in spite of their lower effectiveness and greater expense.

A developing form of "dry" cooling tower comprises a rotating horizontal shaft on which are mounted a series of heat absorbent discs, evenly spaced apart and adapted to rotate between the hot liquid and the cooler air. The discs may be chemically treated or otherwise adapted to repel the hot liquid whereby they may absorb heat but not liquid. Thus the discs remain essentially dry, and upon rotation, only heat is transferred to the air.

The present invention is directed to an arrangement for positively spacing apart the discs on a rotary shaft of a "dry" cooling tower and eliminating the inner portion of each disc to reduce the weight thereof, the material requirement, and the cost of operation. An axial support for the peripheral edges of all discs that lie spaced along the longitudinal axis of a rotary drive shaft is provided whereby the inner portion of each disc may be satisfactorily eliminated to provide the above specified advantages.

DESCRIPTION OF THE PRIOR ART

A cooling tower utilizing a series of axially aligned discs that rotate upon a horizontal rotor shaft is generally shown by U.S. Pat. No. 3,804,155 wherein heat from a stream of hot water is carried to a mass of cooler air by the rotating discs. In this patent each disc comprises a circular plate-like member that is centrally secured to a horizontal shaft. Inasmuch as only the outer periphery of each disc is submerged in both fluid streams, the actual heat transfer is effected only at the outer periphery of each disc. Consequently, the inner portion of each disc becomes in effect a dead weight that also increases the material requirements of the apparatus and increases its cost of operation. The inner portion of each disc therefore serves no essential function except providing means by which each disc is secured to the horizontal shaft.

SUMMARY OF THE INVENTION

The present invention accordingly provides a cooling tower having a plurality of discs on a horizontal shaft that rotates continuously between a hot liquid and a cool gas in order that heat from the liquid may be transmitted to the cooler gas. More particularly, my invention relates to an arrangement for axially supporting a series of annular rings on a horizontal shaft of a rotary cooling tower whereby the central portion of each ring that is not used to perform a heat transfer function may be eliminated to substantially reduce the weight and cost of manufacturing a unit, and simultaneously reduce its cost of operation.

BRIEF DESCRIPTION OF THE DRAWINGS

The invention is further defined with reference to the accompanying drawing in which.

DESCRIPTION OF THE PREFERRED EMBODIMENT

Figure 1:
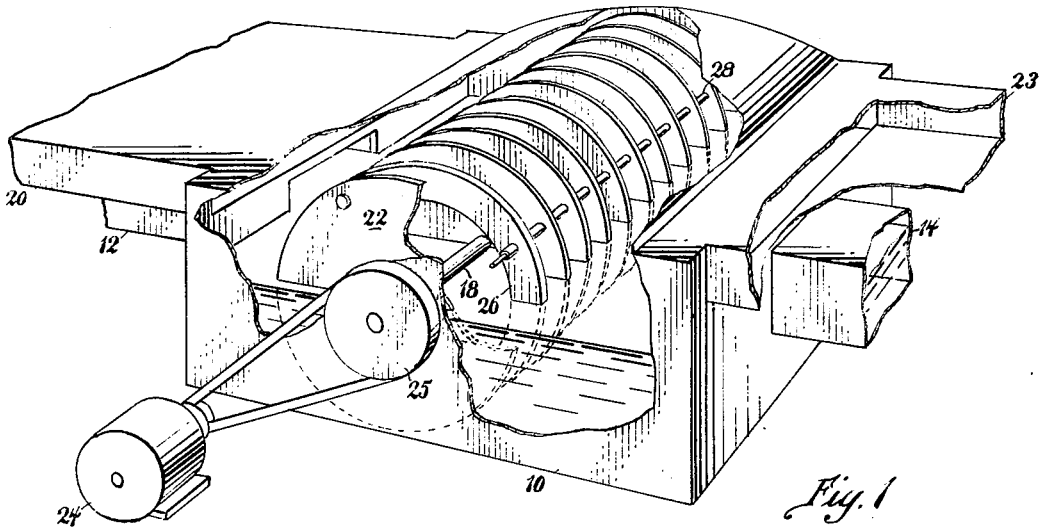
FIG. 1 is a perspective view of a rotary cooling tower according to the invention.
Figure 2:
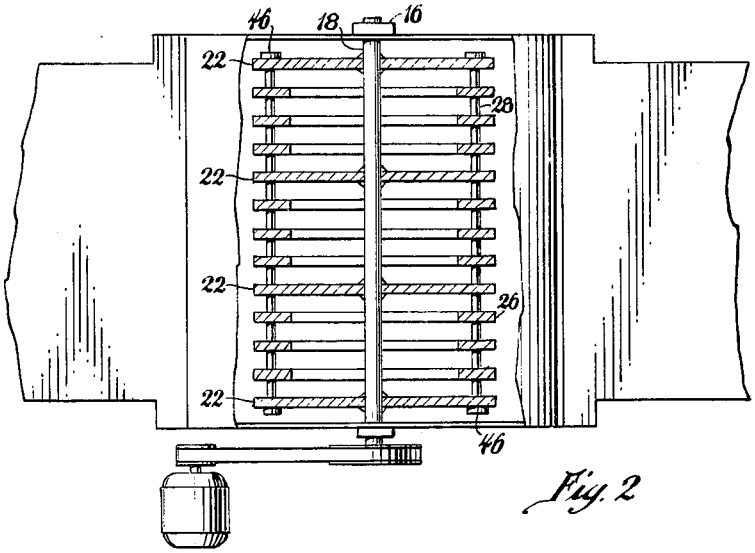
FIG. 2 is a top view of a rotor comprised of axially aligned elements having axial supports therefor.

The heat exchanger of this invention comprises a housing that includes a lower basin 10 having an inlet for hot liquid 12 and an outlet 14 for the liquid after it has been suitably cooled. The housing supports horizontally aligned bearings 16 for a horizontally disposed shaft 18 therebetween. A plurality of concentrically disposed discs 22 are carried by the horizontal shaft such that the lower part of each disc is disposed in the lower basin containing the hot liquid while the upper parts thereof are being contacted by a cool gas such as air flowing through inlet 20 and outlet 23. As the discs are slowly rotated about their horizontal axis by a prime mover such as a motor 24 and suitable drive train 25, the discs are continuously moved between the hot liquid and the cool gas whereby heat from the liquid is continuously being absorbed by the heat absorbent element, and upon rotation thereof, is transferred to the flowing gas.

The hot liquid supplied to the lower basin 10 through inlet 12 and being exhausted through outlet 14 is maintained at a level somewhat below the level of the axis of the horizontally disposed shaft 18 whereby only the outer periphery of each disc is continuously immersed in the hot liquid while the upper portion thereof is being contacted by the cool air.

Although cool air is usually permitted to flow over the entire assembly of discs and the horizontal shaft not immersed by the hot liquid, it has been discovered that resistance to flow becomes excessive adjacent the horizontal shaft 18 so that maximum flow occurs only over the outer peripheral portion of each disc. Consequently, the inner portion of each disc is contacted by the hot gases to absorb heat therefrom, but it is not suitable contacted by the cooler air. Thus the inner portion of each disc becomes relatively "dead" area having little heat transfer to compensate for the additional material it utilizes, the additional weight it comprises, and the additional power it requires to rotate and maintain in continuous operation.

Accordingly, several centrally pierced discs 22 are mounted in spaced relation upon a central shaft 18 and welded thereto to provide a spacing therebetween. This spacing between discs 22 is in turn occupied by a plurality of evenly spaced annular members 26 that have the same outer diameter as the discs 22 but have no central web portion for attaching to the central shaft 18. These annular members 26 are then supported in axial alignment with the discs 22 by support rods 28 that extend axially from the discs 22 that are in turn mounted on shaft 18.

Each axial support rod 28 is made up from individual telescopic segments that include a cylindrical spacer 32 with a cylindrical protuberance 34 that extends concentrically from one end thereof. The protuberance 34 is adapted to extend through an opening in each annular member 26 or each disc 22 until a shoulder 37 thereof lies in an abutting relationship therewith. Another spacer 32 is then pressed on protuberance 34 to provide another spacing means for an adjacent annular member 26. This operation is repeated until a succession of spacers 32, annular members 26 and discs 22 comprises a rotor of predetermined size.

During the actual construction of a rotor, a central shaft 18 is first inserted axially in the central aperture of a disc 22 and welded thereto. Each disc 22 and each annular member 26 is provided with arcuately spaced apertures that are adapted to receive the axial rods 28. The end disc 22 with axially connected shaft 18 is then placed with the shaft 18 in a vertical position, and a spacer 32 with a cavity 38 in alignment with one of said apertures in a disc is welded permanently thereto with protuberance 34 of each spacer extending outward away from the disc. An annular member 26 is then placed over the assembly with each protuberance 34 extending through an aligned aperture thereof until a shoulder 37 abuts the side of the annular member. Another spacer 32 is then telescopically fitted to each protuberance 34 and another annular member 26 is then aligned with and fitted on each protuberance. After a predetermined number of annular members have been assembled in axial alignment, an end disc 22 is again placed on the spacers 32 and the apertured central web is welded to the central shaft 18 whereby discs 22 are permanently secured to shaft 18 by welding and the intermediate annular members 26 are held in a tight relationship by a friction fitting therebetween.

After disc 22 is secured to shat 18, a succession of annular members 26 and additional discs 22 is assembled in a similar manner until the rotor includes a predetermined number of annular members.

Figure 3:
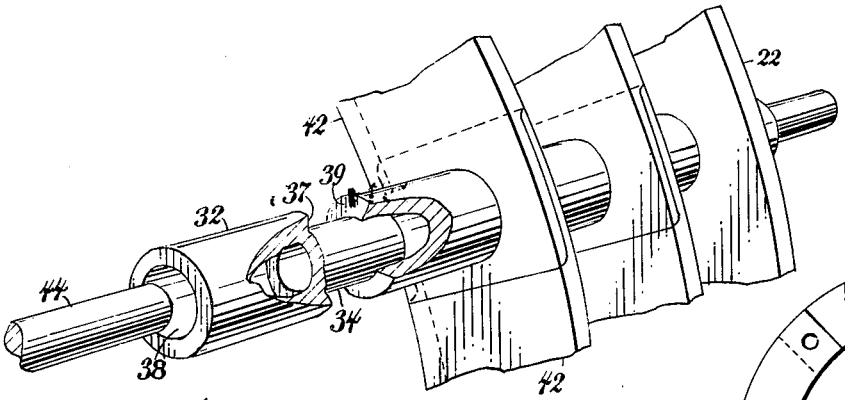
FIG. 3 is a perspective view of a telescopic type element spacer.
Figure 4:
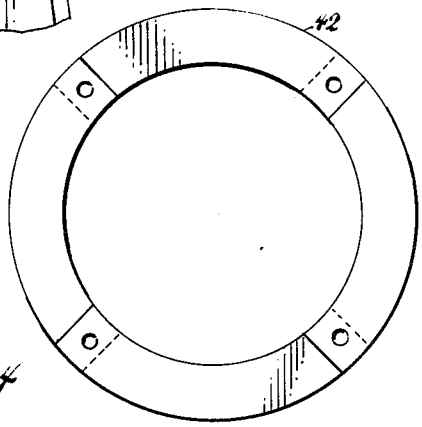
FIG. 4 is an end view of an annular element comprised of arcuate segments.

An alternative arrangement whereby annular members 26 may be made up from a series of abutting segments 42 is shown in FIGS. 3 and 4. Here the laterally adjacent annular members are made up from arcuate segments that overlap at their ends and are apertured to receive the individual telescopic spacers 32–34.

Additional rigidity may be imparted to the rotor assembly by extending a structural rod 44 through aligned cavities 38 of the telescopic sections 34 and bonding each end 46 thereof to the disc at which it terminates.

I claim:

1. A cooling tower for the transfer of heat between a hot liquid and a cool gas including a housing having inlet and outlet ports for the hot liquid adapted to maintain a predetermined depth of hot liquid in said housing, bearing means defining an axis of rotation that lies above the surface of said liquid, a horizontal shaft mounted on said bearing means, a pair of disc members axially mounted on said horizontal shaft and axially spaced apart to provide a spacing therebetween, a plurality of annular heat absorbent elements intermediate the disc members lying in said spacing concentrically spaced from said horizontal shaft, and support means extending axially between disc members adapted to support the annular heat absorbent elements comprising a series of telescopic rod segments that together form composite rods extending between discs to simultaneously separate said annular elements and provide a support therefor.

2. A cooling tower as defined in claim 1 wherein said rod segments comprise cylindrical members that have a protuberance at one end and a cavity at the other.

3. A cooling tower as defined in claim 2 wherein the protuberance and the cavity in said segments are both of cylindrical configuration.

4. A cooling tower as defined in claim 3 wherein the inside diameter of said cavity exceeds the outside diameter of said protuberance to provide a snug fit when adjacent rod segments are pressed together.

5. A cooling tower as defined in claim 4 wherein said cavity extends completely through each cylindrical member and the protuberance extending axially therefrom to provide a passageway that extends axially through adjacent segments of the composite rod.

6. A cooling tower as defined in claim 5 including a tension member extending axially through the passageway of telescopic segment members, and means connecting ends of said tension member to the disc members on said horizontal shaft.

7. A cooling tower as defined in claim 6 including several pairs of spaced disc members having annular heat absorbent elements therebetween.

* * * * *